US005299485A

United States Patent [19]

Denton

[11] Patent Number: 5,299,485

[45] Date of Patent: Apr. 5, 1994

[54] STRINGED INSTRUMENT PICK AND SLIDE HOLDER

[76] Inventor: Dean M. Denton, 164 A Kingston Rd., Danville, N.H. 03819

[21] Appl. No.: 60,854

[22] Filed: May 12, 1993

[51] Int. Cl.[5] ..... G10D 3/18

[52] U.S. Cl. ..... 84/329; 84/322; 84/319; D17/20

[58] Field of Search ..... 84/329, 322, 319, 318, 84/317, 316, 315; D17/20

[56] References Cited

U.S. PATENT DOCUMENTS

| | | | |
|---|---|---|---|
| D. 309,674 | 8/1990 | Gervase | D3/30.1 |
| 3,752,029 | 8/1973 | Watrous | 84/329 |
| 4,067,255 | 1/1978 | Camaioni | 84/322 |
| 4,135,431 | 1/1979 | Ferguson | 84/329 |
| 4,328,733 | 5/1982 | Smith | 84/319 |
| 4,467,693 | 8/1984 | Nasfell, Jr. | 84/329 |
| 4,546,688 | 10/1985 | Cuccio | 84/327 |
| 4,785,708 | 11/1988 | Vaughan | 84/329 |
| 4,790,232 | 12/1988 | Rosen | 84/329 |
| 4,890,531 | 1/1990 | Tischer | 84/329 |
| 4,982,641 | 1/1991 | Duhart | 84/329 |
| 5,127,300 | 7/1992 | Silverman | 84/329 |

*Primary Examiner*—Michael L. Gellner
*Assistant Examiner*—Cassandra C. Spyrou
*Attorney, Agent, or Firm*—Daniel J. Bourque

[57] ABSTRACT

A combined pick and slide holder for a stringed musical instrument is disclosed which includes a pick and slide holder body formed by first and second parallel major planer surfaces separated a predetermined distance, and establishing first and second pairs of parallel sides. One of the parallel sides of the first pair of parallel edges includes a pick holder compartment disposed inwardly from the side and extending between the first and second major planer surfaces, and including first and second pick holder compartment walls. A resilient pick holder member is disposed in the pick holder compartment and frictionally engages a plurality of stringed musical instrument picks in the compartment until forcibly removed by a user. The pick and slide holder also includes a slide holder member proximate the other parallel side of said first pair of parallel edges. The slide holder member includes a first region uncoupled from the pick and slide holder body formed by a cutout region extending from one of the sides of the second pair of parallel edges toward, but not completely to the other parallel side of the second pair of parallel edges. The slide holder member is inserted through a central region of an annular shaped slide, for frictionally engaging the slide with the slide holder member and the attached musical instrument support strap. Also included are means for facilitating attachments of the combined pick and slide holder to a musical instrument support strap for use by either right or left handed users and for temporarily holding a cigarette during a musical performance.

10 Claims, 3 Drawing Sheets

STRINGED INSTRUMENT PICK AND SLIDE HOLDER

FIELD OF THE INVENTION

This invention relates to pick and slide holders for stringed musical instruments and more particularly, to a combination pick and slide holder which attaches to an instrument's support strap, and holds both a slide as well as a plurality of string picks.

BACKGROUND OF THE INVENTION

Many stringed musical instruments, such as guitars, are often played with the assistance of devices such as picks and slides. Picks are used by a musician to energize or vibrate the strings, while a slide is used to depress one or more strings, and is generally slid over the strings up and down the neck of the musical instrument, causing changes in the tone of one or more energized strings.

Musicians utilizing these devices during a performance, however, often find themselves in need of replacement picks due to the loss or breakage of their existing pick. Additionally, since a slide is not generally used continuously, a convenient but easily accessible location must be found to store the device when not in use.

Various prior art solutions to this problem have been suggested. Some of the prior art devices include devices which hold multiple picks. These devices, however, are not convenient to use in that they do not keep the picks immediately available to the musician. For example, some of the prior art devices suggest that picks and/or slides be stored on a microphone stand, or on an amplifier. Given the current state of wireless musical amplification, as well as in the case of strolling musicians, such devices do not make the picks and slides easily accessibly to the musician.

Other prior art devices attach directly to a guitar or other similar stringed instrument. Professional musicians often pay thousands of dollars for their instruments and thus, are not willing to deface their instruments by permanently or semipermanently attaching such prior art holders to their instrument. Additionally, it is important to note that most instruments include custom designed cases. Therefore, most musical instruments will not fit in their cases if a pick or slide holder is attached to the front portion of the musical instrument.

One additional and further problem faced by musicians is often where to place a lighted cigarette during their performance.

Accordingly, what is required is a small, lightweight and inexpensive combination pick and slide holder which will hold or accommodate a plurality of picks and at least one slide, frictionally engaging these devices so they cannot be dislodged without applying some force by the user. Further, such a device should be easily accessible to a strolling or "wireless" musician while not attaching directly to the musician's instrument.

SUMMARY OF THE INVENTION

The present invention features a combined pick and slide holder for a stringed musical instrument which is easily and conveniently mountable to a stringed musical instrument support strap, thus eliminating the need for a user to permanently attach the combined pick and slide holder to an expensive musical instrument. Additionally, the combined pick and slide holder of the present invention mounts to the stringed musical instrument support strap in such a manner as to make the plurality of picks and the slide holder immediately readily available to the user should the user's present pick drop or break.

The combined pick and slide holder of the present invention includes a pick and slide holder body of generally solid construction, having first and second parallel major planer surfaces separated by a predetermined distance. The pick and slide holder body thus includes first and second pairs of parallel edges.

The first pair of parallel edges includes first and second parallel sides having a first predetermined length, while the second pair of parallel edges similarly includes first and second parallel sides having a second predetermined length. The second pair of parallel edges is disposed perpendicular to the first pair of parallel edges. In the preferred embodiment, the predetermined length of the second pair of parallel edges is shorter than the predetermined length of the first pair of parallel edges.

At least one of the first and second parallel sides of the first pair of parallel edges includes a pick holder compartment disposed inwardly from one of the first and second parallel sides of the first pair of parallel edges. The pick holder compartment extends between the first and second major planer surfaces and includes first and second pick holder compartment walls generally parallel to the first and second major planer surfaces.

The combined pick and slide holder of the present invention further includes a resilient pick holder member, disposed in the pick holder compartment, for frictionally engaging a plurality of stringed musical instrument picks with the combined pick and slide holder, for holding the plurality of stringed musical instrument picks in place in the pick holder compartment, until forcibly removed by the user.

In the preferred embodiment, the resilient pick holder member includes a single unitary resilient member which is folded in half and inserted into the pick holder compartment. The resilient member may include materials such as a neoprene rubber. Thus, the resilient member frictionally engages a plurality of picks between the resilient member and at least one of the first and second pick holder compartment walls, for holding the plurality of picks in place in the pick holder compartment.

The stringed musical instrument pick and slide holder of the present invention also includes a slide holder member proximate the other of the first and second parallel sides of said first pair of parallel edges which is opposite and diametrically opposed from the one parallel side including the pick holder compartment. The slide holder member includes a first region which is uncoupled from the pick and slide holder body, as well as a second region coupled to the pick and slide holder body.

The first region which is uncoupled from the pick and slide holder body is formed by a cutout region in the pick and slide holder body, the cutout region extending from one of the first and second parallel sides of the second pair of parallel sides toward, but not completely to the other of the first and second pair of parallel sides of the second parallel edges. Thus, the first uncoupled region of the slide holder member may be inserted through a central region of an annular shaped slide. The annular shaped slide is frictionally engaged between the first uncoupled region of the slide holder member and a support strap to which the pick and slide holder is attached.

The combined pick and slide holder of the present invention also features a system for facilitating attachment of the combined pick and slide holder to a musical instrument support strap. Such a system may include a spring loaded clip. In the preferred embodiment, however, the pick and slide holder body of the present invention includes a plurality of threaded holes extending from the first major planer surface to the second major planer surface. A corresponding plurality of screws or other threaded members may then be inserted through a stringed musical instrument support strap into the threaded holes of the pick and slide holder body from either the first or second major planer surface. Thus, the combined pick and slide holder of the present invention may be mounted for use by either a left or right handed user.

As an additional feature, the combined pick and slide holder of the present invention may include a hole in the pick and slide holder body which is just slightly larger than the diameter of a cigarette, for allowing the user of the combined pick and slide holder of the present invention to insert and temporarily store a cigarette during a musical performance.

BRIEF DESCRIPTION OF THE DRAWINGS

These and other features and advantages of the present invention will be better understood by reading the following detailed descriptions, which is read in conjunction with the following Figures wherein.

DETAILED DESCRIPTION OF THE INVENTION

Figure 1:
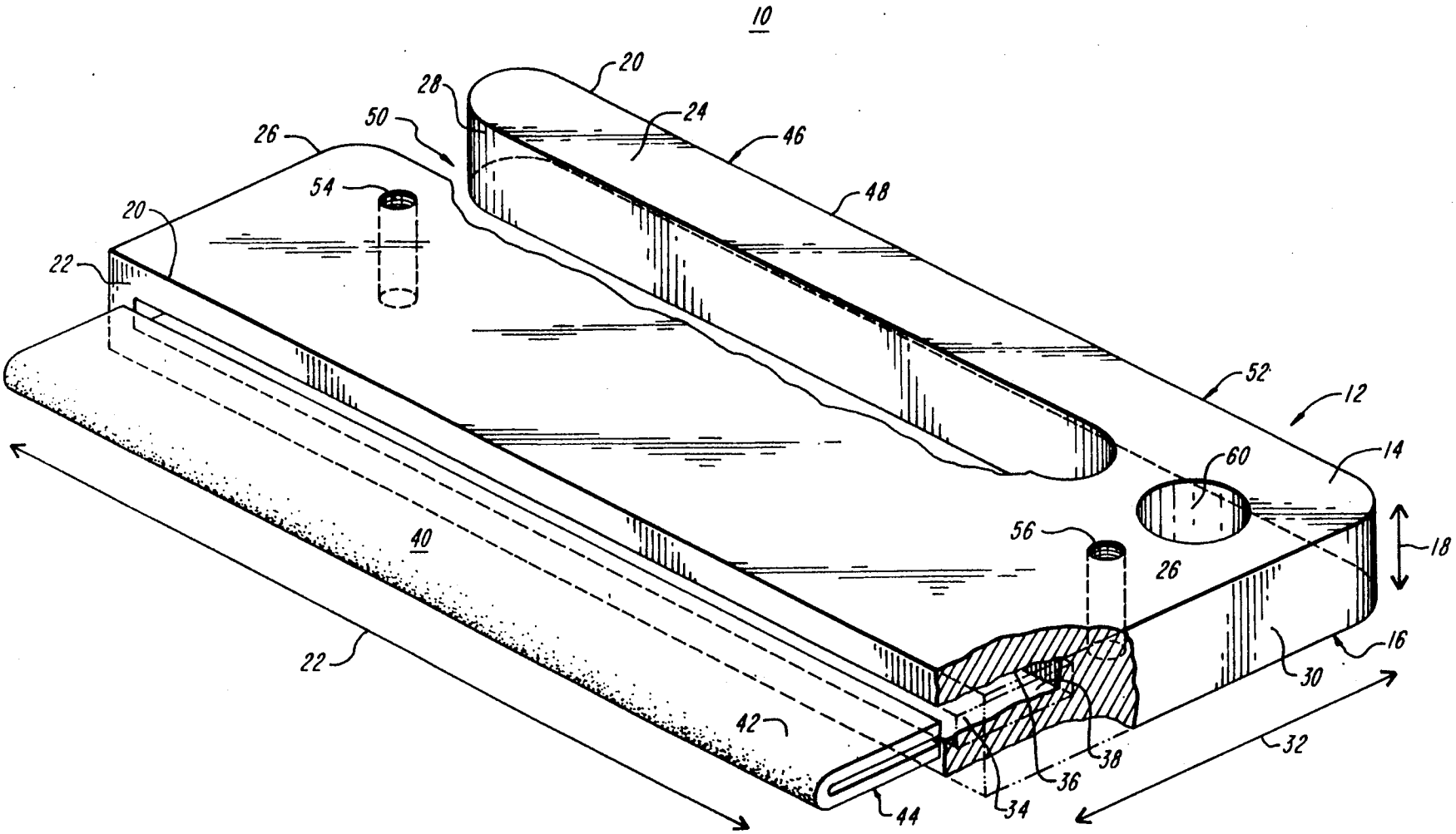
FIG. 1 is a schematic plan view of the combination pick and slide holder of the present invention including the resilient member which serves to restrain or hold the plurality of picks in place.

The combined pick and slide holder of the present invention is shown generally at 10, FIG. 1, and includes a pick and slide holder body 12 including first and second parallel major planer surfaces 14 and 16. The first and second parallel major planer surfaces 14, 16 are separated a predetermined distance indicated generally by arrow 18 which defines the thickness of the pick and slide holder body, which in the preferred embodiment is approximately ⅛ inch. The pick and slide holder body 12 defines a first pair 20 of parallel edges having a first predetermined length indicated generally by arrow 22. The first pair 20 of parallel edges includes first and second parallel sides 22 and 24.

The pick and slide holder body 12 also includes a second pair of parallel edges 26 which also include first and second parallel sides 28 and 30. The first and second parallel sides 28 and 30 of the second pair of parallel edges 26 are disposed perpendicular to the first and second parallel sides 22, 24 of the first pair of parallel edges 20. The second pair 26 of parallel edges has a second predetermined length indicated generally by arrow 32 which in the preferred embodiment is shorter than the first predetermined length 22 of the first pair of parallel edges 20.

In one embodiment which is illustrated for exemplary purposes, the pick and slide holder body 12 has a length 22 of approximately 3 to 4 inches, and a width 32 of approximately 1 ½ inches. Further, it is contemplated that the pick and slide holder body 12 of the present invention will be constructed out of suitable, lightweight material such as machined aluminum or molded plastic.

At least one of the first and second parallel sides (in this illustration, first parallel side 22) of the first pair 20 of parallel edges includes a pick holder compartment 34 formed inwardly from the first parallel side 22 of the first pair of parallel edges 20, and extending between the first and second major planer surfaces 14, 16. The pick holder compartment 34 includes first and second pick holder compartment walls 36 and 38, respectively.

The pick holder compartment 34 is adapted to receive a resilient pick holder member 40 which in the preferred embodiment is single unitary piece of resilient material such as neoprene rubber, which has been folded in half. Once inserted into the pick holder compartment 34, a first surface 42 of resilient member 40 is expanded and forced against first pick holder compartment wall 36, while a second resilient member surface 44 is expanded and forced against second wall 38 of pick holder compartment 34.

Once inserted into the pick holder compartment 34, the resilient member 40 allows, in this embodiment, a plurality of picks (not shown in this Figure for sake of clarity) to be frictionally engaged between one of the first and second surfaces 42, 44 of resilient member 40 and one of the first and second pick holder compartment walls 36, 38 of the pick holder compartment 34. It is to be understood, however, that the resilient member may be inserted in other manners other than illustrated in the exemplary drawing. Additionally, other types of resilient members may be utilized and are considered to be within the scope of the present invention.

The combination pick and slide holder of the present invention also includes a stringed musical instrument slide holder member 46 which is located proximate the second side 24 of the first pair of parallel edges 20, and diametrically opposed from the first edge 22 including the pick holder compartment 34. The stringed musical instrument slide holder member 46 includes a first region 48 which is uncoupled from the pick and slide holder body 12 by virtue of a cutout region 50 in the pick and slide holder body 12. The cutout region 50 extends from the first parallel side 28 of the second pair of parallel edges 26 toward, but not completely to, the second parallel side 30 of the second pair of parallel edges 26.

The stringed musical instrument slide holder 46 also includes a second region 52 which is coupled to the remainder of the pick and slide holder body 12. Accordingly, the stringed musical instrument slide holder member 46 is adapted for being inserted through a central region of an annular shaped stringed musical instrument slide (not shown) and frictionally engages the slide with and between the stringed musical instrument slide holder member and a stringed musical instrument support strap (not shown), for retaining the slide on the combination pick and slide holder 10 of the present invention until forcibly removed by a user.

The present invention further includes a mechanism for facilitating the attachment of the present combined pick and slide holder to a musical instrument support strap. In the preferred embodiment, this includes first and second threaded holes 54, 56 which extend from the first parallel major planer surface 14 to the second parallel, major planer surface 16. The first and second threaded holes 54, 56 are adapted for engaging with first and second threaded screws (not shown) which engage the combination pick and slide holder 10 of the present invention to a stringed musical instrument support strap.

Providing the first and second holes 54, 56 from one major planer surface to the other allows the combination pick and slide holder of the present invention to be fastened to a support strap against either the first or second major planer surface, thus allowing the device of the present invention to be adapted for use by either a right handed or left handed musician.

Additionally, a further feature of the present invention is the provision of hole 60 which is just slightly larger in diameter than a typical cigarette, for allowing the musician to temporarily store a lighted cigarette in the hole 60 during a musical performance.

Figure 2:
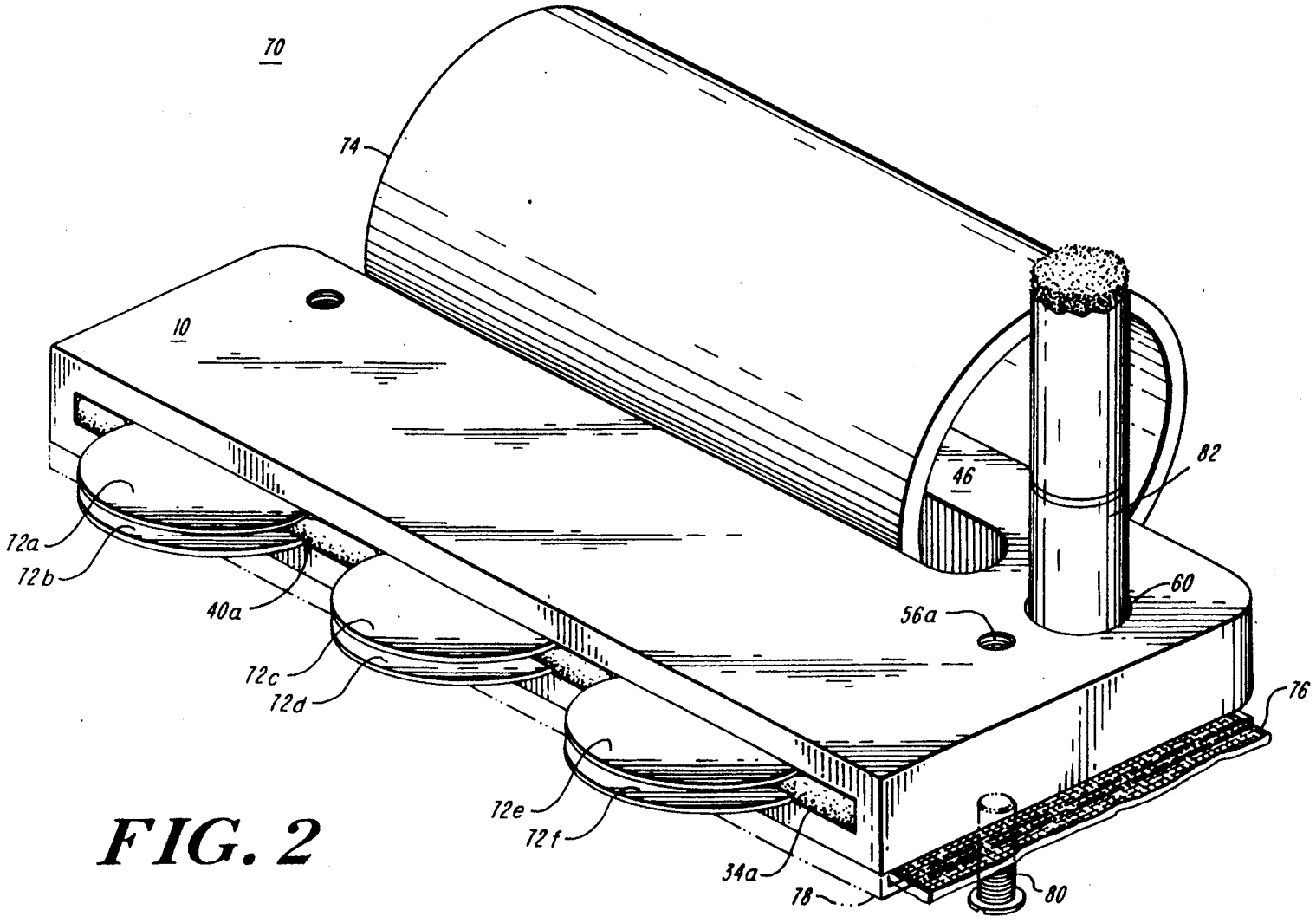
FIG. 2 is a schematic illustration of the combination pick and slide holder of the present invention with a plurality of picks, a slide, and cigarette shown in place in and on the device.

The use of a combination pick and slide holder according to the present invention is illustrated generally at 70, FIG. 2, wherein is shown pick and slide holder 10 into which has been inserted a plurality of picks 72*a*–72*f* between the resilient member 40*a* and the walls of the pick holder compartment 34*a*. Also illustrated is a stringed musical instrument slide 74 inserted over the stringed musical instrument slide holder member 46.

The combination pick and slide holder 10 of the present invention is adopted to attach, as previously described, to a stringed musical instrument support strap 76 by means of a spring type clip 78 or, as previously discussed in conjunction with the preferred embodiment, utilizing a threaded screw type device 80 inserted into a plurality of threaded holes 56*a*. Additionally, also as previously disclosed, the present invention includes hole 60 into which may be inserted a lit cigarette 32 when it is desired not to be held by the musician, such as during a musical performance.

Figure 3:
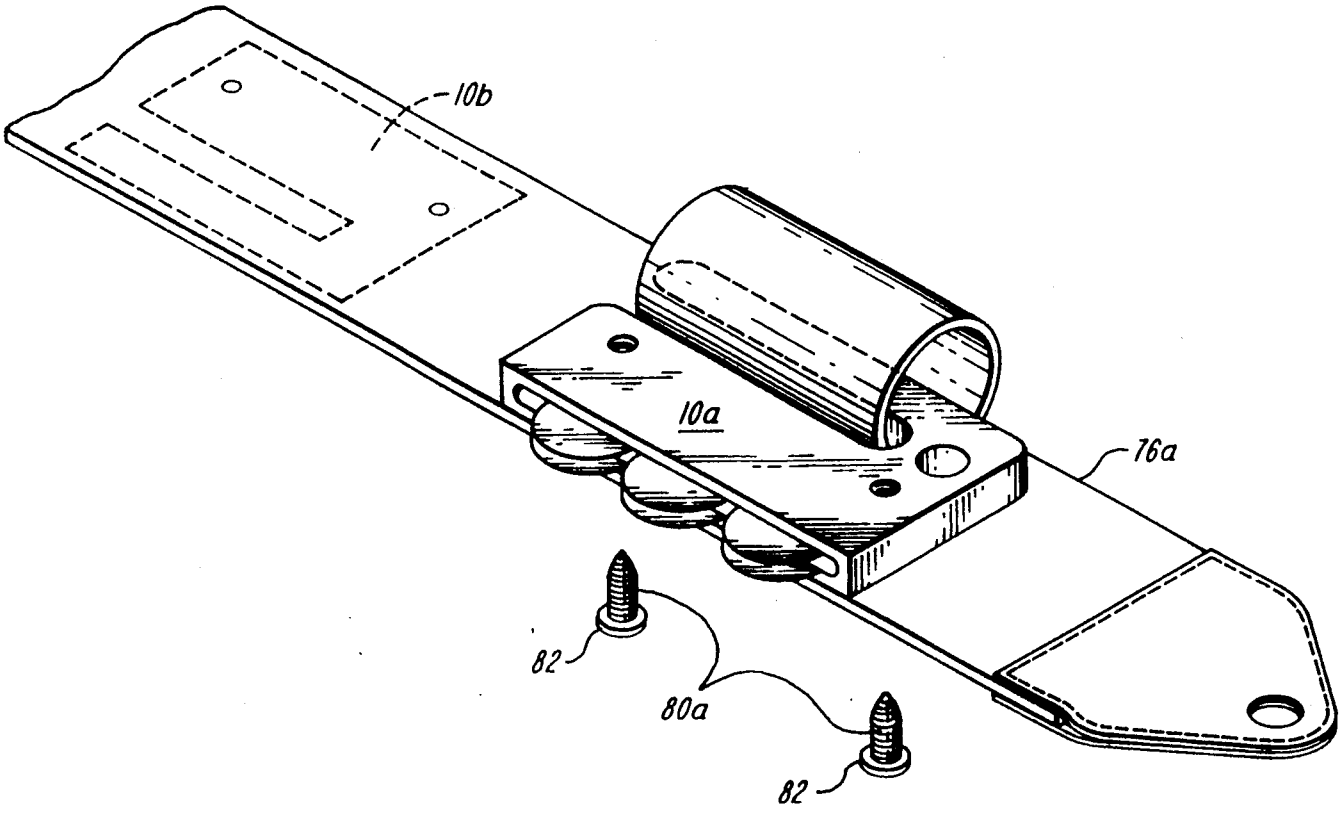
FIG. 3 is a schematic illustration of the combination pick and slide holder of the present invention mounted to a musical instrument support strap.

As further illustrated in FIG. 3, the combination pick and slide holder 10*a* according to the present invention may be fastened to musical instrument support strap 76*a* by means of a plurality of screws 80*a* having finger grippable type heads 82. As previously disclosed, a further advantage of the present invention is the ability to fasten the combination pick and slide holder of the present invention 10*b* through a second one of the first and second parallel, major planer surfaces to provide for use by either a left or right handed user.

Accordingly, the present invention provides a versatile, adaptable and easy to use combination pick and slide holder which frictionally engages a plurality of stringed musical instrument picks in a pick holder compartment utilizing a resilient member, and which engages a stringed musical instrument slide between the slide holder of the present invention and an adjacent, attached, musical instrument support strap.

Modifications and substitutions by one of ordinary skill in the art are considered to be within the scope of the present invention, which is not to be limited accept by the claims which follow.

I claim:

1. A combined pick and slide holder for attaching to a support strap coupled to a stringed musical instrument, comprising:

a pick and slide holder body having first and second parallel major planer surfaces separated a predetermined distance, said predetermined distance forming a pick and slide holder body thickness, said first and second parallel major planer surfaces and said pick and slide holder body thickness defining a first pair of parallel edges having a first predetermined edge length, and a second pair of parallel edges having a second predetermined edge length, said second pair of parallel edges perpendicular to said first pair of parallel edges, each of said first and second pair of parallel edges including first and second parallel sides;

one of said first and second parallel sides of said first pair of parallel edges including a pick holder compartment disposed inwardly from said one of said first and second parallel sides of said first pair of parallel edges, and extending between said first and second major planer surfaces, said pick holder compartment including first and second pick holder compartment walls;

a resilient pick holder member, disposed in said pick holder compartment, for frictionally engaging said plurality of stringed musical instrument picks and holding said plurality of stringed musical instrument picks in said pick holder compartment until forcibly removed by a user; and a stringed musical instrument slide holder member proximate the other of said first and second parallel sides of said first pair of parallel edges, said other of said first and second parallel sides disposed opposite and diametrically opposed from said one of said first and second parallel sides including said pick holder compartment, said stringed musical instrument slide holder member including a first region uncoupled to the remainder of said pick and slide holder body, and a second region coupled to said pick and slide holder body, said first region formed by a cutout region in said pick and slide holder body, said cutout region extending from one of said first and second parallel sides of said second pair of parallel edges toward, but not completely to the other of said first and second parallel sides of said first and second parallel edges, said slide holder member adapted for being inserted through a central region of an annular shaped stringed musical instrument slide, and for frictionally engaging said stringed musical instrument slide with said support strap to which said pick and slide holder is attached and with said slide holder member, for retaining said musical instrument slide until forcibly removed by a user; and means for facilitating an attachment of said combined pick and slide body to said musical instrument support strap.

2. The combined pick and slide holder of claim 1, wherein said resilient pick holder member frictionally engages a plurality of picks between said resilient member and at least one of said first and second pick holder compartment walls.

3. The combined pick and slide holder of claim 1, wherein said predetermined length of said second pair of parallel edges of said pick and slide holder body is shorter than said predetermined length of said first pair of parallel edges.

4. The combined pick and slide holder of claim 1, wherein said means for facilitating attachment of said combined pick and slide holder to said musical instrument support strap includes a spring loaded clip.

5. The combined pick and slide holder of claim 1, wherein said means for facilitating attachment of said combined pick and slide holder to said musical instrument support strap includes a plurality of threaded holes in said pick and slide holder body, and a corresponding plurality of screw members, operative for being inserted through said musical instrument support strap and threaded into said corresponding plurality of threaded holes in said pick and slide holder body.

6. The combined pick and slide holder of claim 1, further including means for holding a cigarette.

7. The combined pick and slide holder of claim 6, wherein said means for holding a cigarette includes a hole in said pick and slide holder body, said hole having a diameter which is slightly larger than a diameter of said cigarette.

8. The combined pick and slide holder of claim 1, wherein said resilient pick holder member includes a single unitary piece of resilient material folded in half and inserted into said pick holder compartment.

9. The combined pick and slide holder of claim 8, wherein said resilient pick holder member includes neoprene rubber.

10. The combined pick and slide holder of claim 5, wherein said threaded holes extend from said first parallel major planer surface to said second parallel major planer surface, so as to allow said pick and slide holder body to be mounted to said stringed instrument support strap against either one of said first and second parallel major planer surfaces, for facilitating use of said combined pick and slide holder by a right handed or a left handed user.

* * * * *